US009684323B2

(12) United States Patent
Nakagawara

(10) Patent No.: US 9,684,323 B2
(45) Date of Patent: Jun. 20, 2017

(54) REGULATOR CIRCUIT THAT SUPPRESSES AN OVERSHOOT OF OUTPUT VOLTAGE

(71) Applicant: KABUSHIKI KAISHA TOSHIBA, Tokyo (JP)

(72) Inventor: Chikashi Nakagawara, Yokohama Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 59 days.

(21) Appl. No.: 14/634,703

(22) Filed: Feb. 27, 2015

(65) Prior Publication Data

US 2016/0033983 A1 Feb. 4, 2016

(30) Foreign Application Priority Data

Jul. 31, 2014 (JP) ..... 2014-156917

(51) Int. Cl.
*G05F 1/575* (2006.01)
*G05F 5/00* (2006.01)
*G05F 3/00* (2006.01)

(52) U.S. Cl.
CPC ..... *G05F 1/575* (2013.01); *G05F 3/00* (2013.01); *G05F 5/00* (2013.01)

(58) Field of Classification Search
CPC ..... G05F 1/575
USPC ..... 323/280
See application file for complete search history.

(56) References Cited

U.S. PATENT DOCUMENTS

2008/0100272 A1* 5/2008 Yoshio ..... G05F 1/56 323/266
2011/0141784 A1* 6/2011 Lee ..... H02M 7/217 363/127
2011/0260643 A1* 10/2011 Huang ..... G09G 3/3406 315/294
2015/0042292 A1* 2/2015 Mao ..... H02J 7/045 320/162

FOREIGN PATENT DOCUMENTS

JP 04-116708 4/1992
JP 10-341141 12/1998
JP 2005-165716 6/2005

* cited by examiner

*Primary Examiner* — Jue Zhang
*Assistant Examiner* — Trinh Dang
(74) *Attorney, Agent, or Firm* — Patterson & Sheridan, LLP

(57) ABSTRACT

A regulator circuit includes a first MOS transistor having a current channel connected between an input terminal and an output terminal, a regulator control circuit configured to control an amount of a current flowing through the current channel of the first MOS transistor towards the output terminal, a second MOS transistor having a current channel connected between the input terminal and the current channel of the first MOS transistor, and a body diode, a forward direction of which is along a direction from the input terminal to the output terminal, and a switch control circuit configured to switch off the second MOS transistor when a voltage at the input terminal decreases to a predetermined value that is equal to or greater than a voltage at the output terminal.

12 Claims, 10 Drawing Sheets

REGULATOR CIRCUIT THAT SUPPRESSES AN OVERSHOOT OF OUTPUT VOLTAGE

CROSS-REFERENCE TO RELATED APPLICATION

This application is based upon and claims the benefit of priority from Japanese Patent Application No. 2014-156917, filed Jul. 31, 2014, the entire contents of which are incorporated herein by reference.

FIELD

Exemplary embodiments described herein relate to a regulator circuit.

BACKGROUND

A series regulator is a type of linear regulator and includes a control transistor provided on a current path between an input terminal and an output terminal and a control circuit that controls the control transistor such that an output voltage becomes constant. In general, a MOS transistor is used as the control transistor.

DETAILED DESCRIPTION

Figure 1:
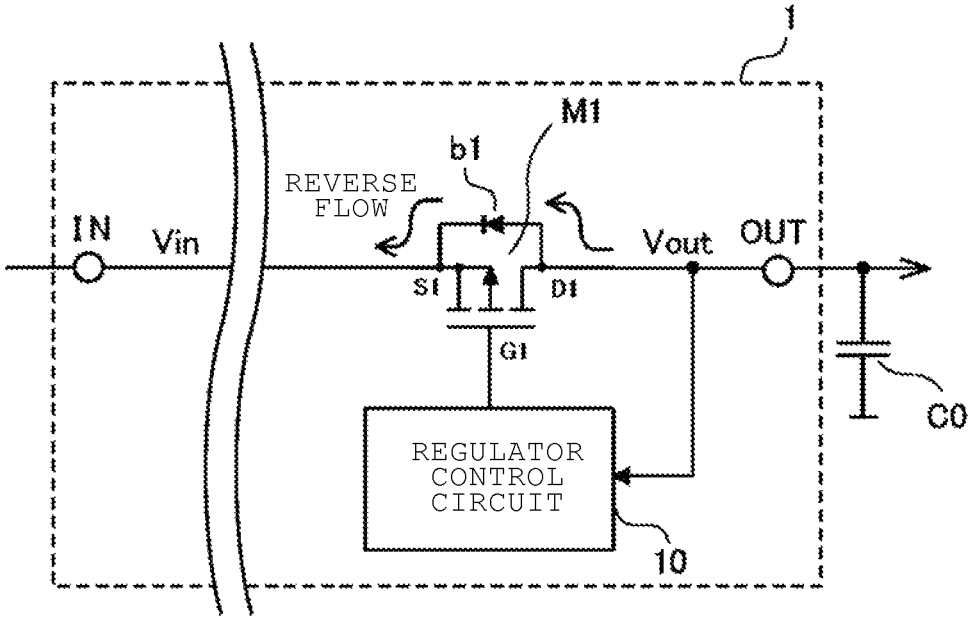
FIG. 1 illustrates a regulator circuit having a P-ch MOSFET that is used for a control transistor.

In a regulator, a voltage at an input terminal may become lower than voltage at an output terminal, for example, when a power source connected to the input terminal is cut off . When the voltage at the input terminal becomes lower than the voltage at the output terminal and a MOS transistor having a body diode is used as the control transistor, a current may flow in reverse, from the output terminal to the input terminal via the body diode.

An exemplary embodiment provides a regulator circuit in which reverse flow of a current is reduced.

In general, according to one embodiment, a regulator circuit includes a first MOS transistor having a current channel connected between an input terminal and an output terminal, a regulator control circuit configured to control an amount of a current flowing through the current channel of the first MOS transistor towards the output terminal, a second MOS transistor having a current channel connected between the input terminal and the current channel of the first MOS transistor, and a body diode, a forward direction of which is along a direction from the input terminal to the output terminal, and a switch control circuit configured to switch off the second MOS transistor when a voltage at the input terminal decreases to a predetermined value that is equal to or greater than a voltage at the output terminal.

Hereinafter, exemplary embodiments will be described with reference to the drawings. In addition, in the figures, the same reference numerals or symbols will be used for the same units.

(First Embodiment)

FIG. 1 illustrates a regulator circuit according to a first embodiment. The regulator circuit 1 is a series regulator having a metal-oxide silicon field-effect transistor (MOSFET) that is used for a control transistor. The regulator circuit 1 is a regulator for a vehicle, for example. An input terminal Vin of the regulator circuit 1 is connected to a power source, such as a battery, a power generator, or the like, and an output terminal Vout is connected to a vehicle-mounted apparatus, such as a drive recorder or a car navigation.

FIG. 1 is an example in which a P-ch MOSFET is used for the control transistor. A MOS transistor M1 is a P-ch MOSFET having a body diode b1 which conducts a current from a drain toward a source. If power supplied to the regulator circuit 1 is stopped by engine stop or the like, a voltage of the input terminal IN becomes lower than a voltage of the output terminal OUT, and a current reversely flows via the body diode b1. In this case, since charges accumulated in a capacitor C0 or the like are emitted through the regulator circuit 1, and the voltage of the output terminal OUT is rapidly decreased. The vehicle-mounted apparatus may perform an apparatus termination operation during a voltage decrease period after the engine is stopped. However, if the voltage is rapidly decreased, the vehicle-mounted apparatus cannot perform the apparatus termination operation during the voltage decrease period. For example, if the vehicle-mounted apparatus is a drive recorder, the drive recorder terminates an operation before retention of a video file is completed.

The reverse flow of the current may be prevented by disposing a diode for reverse flow prevention between the input terminal IN and a source terminal S1. However, in this case, a voltage that reaches the MOS transistor M1 is always decreased by a forward voltage consumed in the diode. The voltage drop increases a minimum operation voltage of an entire product including a regulator circuit. This leads to an increase of energy consumption or an increase of product cost.

Specifically, in a vehicle with an idling stop function, an engine is frequently restarted and a power is greatly consumed, and thus a battery voltage is likely to be lowered. For this reason, if the minimum operation voltage is high, the vehicle-mounted apparatus may stop due to an insufficient voltage when the engine is restarted, or the engine may not be restarted.

Figure 2:
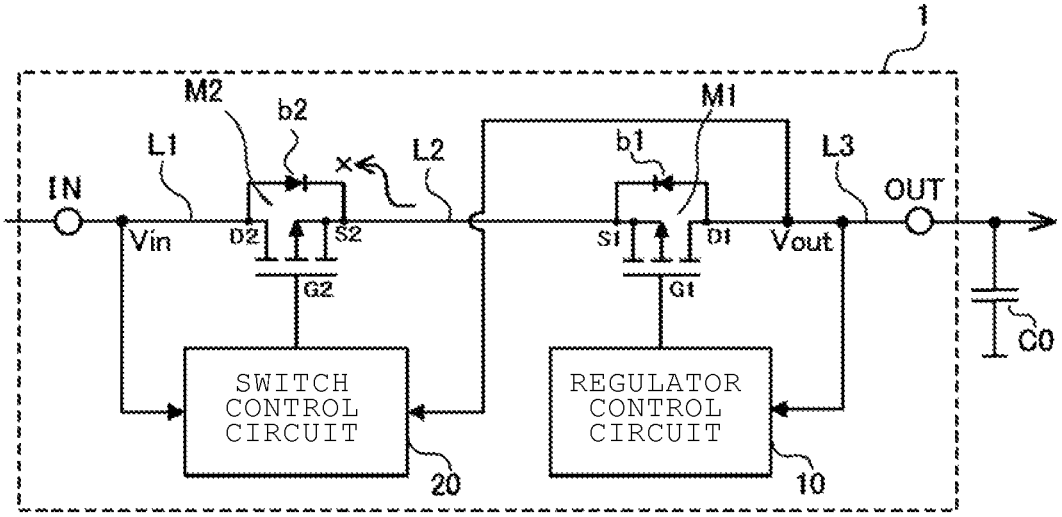
FIG. 2 illustrates a regulator circuit according to a first embodiment.

In the regulator circuit 1 according to the present embodiment, as illustrated in FIG. 2, a MOS transistor M2 is disposed between the input terminal IN and the MOS transistor M1. The MOS transistor M2 is connected to the MOS transistor M1 in an opposite direction to the direction of the MOS transistor M1, in such a manner that a current does not reversely flow via a body diode b2. Then, the MOSFET transistor M2 is switched on when a current does not reversely flow, and is switched off when the current reversely flow. As a result, the regulator circuit 1 suppresses the reverse flow of the current, and does not cause a large voltage drop in its circuit.

In addition, a body diode of a MOSFET is not generally illustrated in a circuit diagram. However, in the present embodiment, for easy understanding of the flow of a reverse current, the body diode is illustrated. Hereinafter, the regulator circuit 1 according to a first embodiment will be described in detail with reference to FIG. 3.

First Specific Example according to First Embodiment

Figure 3:
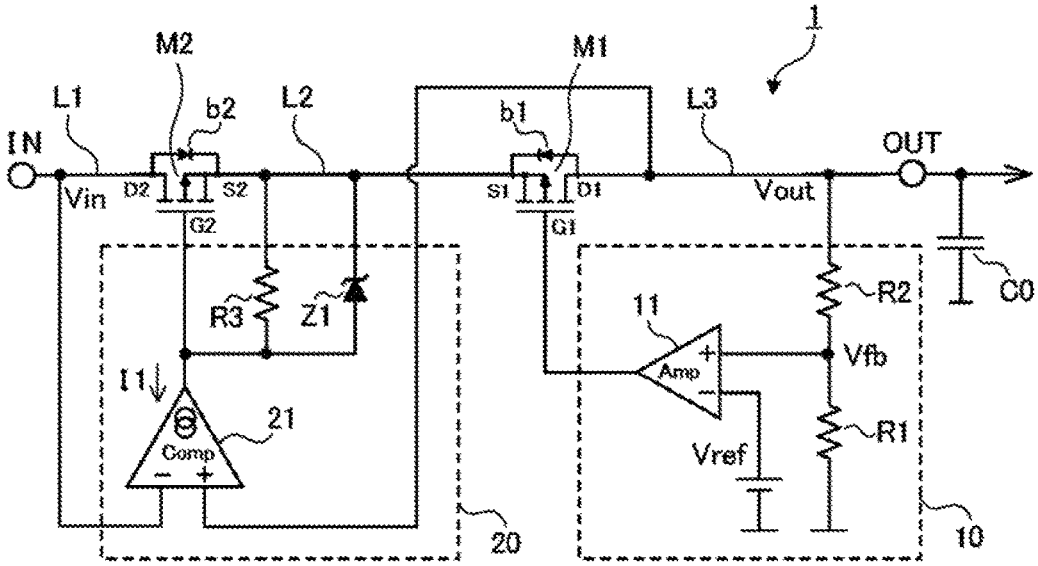
FIGS. 3-6 are specific circuit configuration examples of the regulator circuit illustrated in FIG. 2.

FIG. 3 is a specific circuit configuration example of the regulator circuit 1 in FIG. 2. The regulator circuit 1 includes the MOS transistor M1, the MOS transistor M2, a regulator control circuit 10, and a switch control circuit 20. In addition, the regulator circuit 1 includes the input terminal IN and the output terminal OUT. Current paths that are denoted by L1 to L3 are formed between the input terminal IN and the output terminal OUT. L1 to L3 are paths of a power supply current that is supplied from the input terminal IN and is output through the output terminal OUT. Here, the "power supply current" is a current that is input from a power source, such as a battery, a power generator, or the like, and is output to a connection apparatus such as a vehicle-mounted apparatus. In addition, in the following description, the current path is called a power supply current path, so as to distinguish the current path from other current paths.

The MOS transistor M1 is an enhancement type P-ch MOSFET having a source terminal S1, a drain terminal D1, and a gate terminal G1. The MOS transistor M1 is connected to the power supply current paths. Specifically, the source terminal S1 is connected to a source terminal S2 of the MOS transistor M2 via the power supply current path L2. The drain terminal D1 is connected to the output terminal OUT via the power supply current path L3. In addition, the gate terminal G1 is connected to an output of the regulator control circuit 10. In addition, the MOS transistor M1 may be an N-ch MOSFET. In this case, the source terminal S1 is connected to the power supply current path L3, and the drain terminal D1 is connected to the power supply current path L2.

The MOS transistor M2 is an enhancement type P-ch MOSFET having the source terminal S2, a drain terminal D2, and a gate terminal G2. In addition, the MOS transistor M2 includes a body diode b2. The body diode is called a parasitic capacitor, and is structurally formed in a MOS transistor. In a P-ch MOS transistor, a body diode in which a current flows from a drain toward a source is formed.

The MOS transistor M2 is disposed on the power supply current path, in such a manner that a current passing direction of the body diode b2 is opposite to a current passing direction of the body diode b1 of the MOS transistor M1. Specifically, the MOS transistor M2 is disposed on the power supply current path, in such a manner that a cathode (N-ch semiconductor side) of the body diode b2 is connected to the MOS transistor M1. For this reason, the source terminal S2 is connected to the power supply current path L2, and the drain terminal D2 is connected to the power supply current path L1, in such a manner that the cathode of the body diode b2 is connected to the MOS transistor M1. The gate terminal G2 is connected to an output terminal of the switch control circuit 20. In addition, when the MOS transistor M2 is an N-ch MOSFET, the source terminal S2 is connected to the power supply current path L1, and the drain terminal D2 is connected to the power supply current path L2.

The regulator control circuit 10 controls the MOS transistor M1. The regulator control circuit 10 includes a resistor R1, a resistor R2, and an amplifier 11. The resistor R1 and the resistor R2 divide an output voltage Vout. A voltage that is divided by the resistor R1 and the resistor R2 is input to a plus terminal of the amplifier 11, as a feedback voltage Vfb.

The amplifier 11 controls the MOS transistor M1. A reference voltage Vref is input to a minus terminal of the amplifier 11, and the feedback voltage Vfb is input to a plus terminal. Then, the amplifier 11 amplifies a difference between the voltage that is input to the plus terminal and the voltage that is input to the minus terminal, and outputs the amplified voltage to the gate terminal G1. The MOS transistor M1 adjusts a current that passes through the source and the drain, based on a voltage that is input to the gate terminal G1. As a result, a voltage Vout that is output from the output terminal OUT is maintained constant. In addition, in the circuit, a voltage of (Vref×(R1+R2)/R1) is output from the output terminal OUT.

The switch control circuit 20 operates to suppress a reverse flow of a current. When the input voltage Vin is lower than the output voltage Vout, the switch control circuit 20 switches off the MOS transistor M2, in such a manner that the current flowing through the power supply current path is in a reverse flow state. The switch control circuit 20 includes a resistor R3, a Zener diode Z1, and a comparator 21. One end of the resistor R3 is connected to the source terminal S2, and the other end is connected to the gate terminal G2. In the same manner, a cathode of the Zener diode Z1 is connected to the source terminal S2, and an anode thereof is connected to the gate terminal G2.

The comparator 21 compares voltages and controls the MOS transistor M2. The comparator 21 includes an inverting input terminal (hereinafter, referred to as "minus terminal"), a non-inverting input terminal (hereinafter, referred to as "plus terminal"), and an output terminal. The minus terminal is connected to the power supply current path L1, and the plus terminal is connected to the power supply current path L3. In addition, the output terminal is connected to the gate terminal G2. The power supply current path L1 is a current path from the input terminal IN to the MOS transistor M2, among the entire power supply current paths from the input terminal IN to the output terminal OUT. In addition, the power supply current path L3 is a current path from the MOS transistor M1 to the output terminal OUT, among the entire power supply current paths from the input terminal IN to the output terminal OUT.

In addition, the comparator 21 has a function as a current source. If the voltage Vin that is applied to the minus terminal is lower than the output voltage Vout that is applied to the plus terminal, a reverse flow of a current is generated on the power supply current paths, and the comparator 21 stops an output of a current I1. In addition, if the voltage Vin that is applied to the minus terminal is higher than the output voltage Vout that is applied to the plus terminal, the comparator 21 outputs the current I1. In addition, since the MOS transistor M2 is a P-ch MOSFET, it is necessary for the comparator 21 to apply a negative voltage to the gate terminal G2, in order for the comparator 21 to connect the drain and the source of the MOS transistor M2 to each other. For this reason, the current I1 that is output from the comparator 21 flows in a reverse direction. In addition, when the MOS transistor M2 is an N-ch MOSFET, it is necessary for the current I1 to be a plus current, in order to connect the drain to the source.

Next, an operation of the regulator circuit 1 having such a configuration will be described.

Before a power supply voltage is applied to the input terminal IN, there is no voltage difference between sources and gates of all MOS transistors. For this reason, the MOS transistor M1 and the MOS transistor M2 are both in an OFF state.

However, if the power supply voltage is applied to the input terminal IN, the voltage Vin of the input terminal IN becomes higher than the output voltage Vout of the output terminal OUT. In that case, the minus terminal voltage of the comparator 21 becomes higher than the plus terminal voltage, and thus the comparator 21 outputs the current I1 that flows in a reverse direction. In that case, a negative voltage is applied to the gate terminal G2, and thus the MOS transistor M2 is switched on. As a result, the source and the drain of the MOS transistor M2 are connected to each other, and thus a large voltage drop is not generated between the input terminal IN and the MOS transistor M1.

At this state, the amplifier 11 applies a voltage to the gate terminal G1. The voltage that is applied to the gate terminal G1 by the amplifier 11 is a voltage that is obtained by amplifying a difference voltage between the feedback voltage Vfb and the reference voltage Vref by an amplification rate that is set in advance. As a result, the output voltage Vout is maintained as (Vref×(R1+R2)/R1).

Meanwhile, if an application of the power supply voltage to the input terminal IN is stopped by engine stop or the like, the input voltage Vin becomes lower than the output voltage Vout. In that case, a current flowing through the power supply current path reversely flows via the body diode b1. However, in this case, the voltage Vin at the minus terminal of the comparator 21 also becomes lower than the voltage Vout at the plus terminal, and thus the comparator 21 stops a current output. If so, the voltage at the gate terminal G2 is increased, and thus the MOS transistor M2 is switched off. At this time, the body diode b2 functions as a diode to prevent reverse flow, and thus a current flowing through the power supply current path does not reversely flow. As a result, the output voltage Vout is not rapidly decreased, and thus a vehicle-mounted apparatus may perform a termination operation during a voltage decrease period.

According to the present embodiment, the MOS transistor M2 is disposed between the input terminal IN and the MOS transistor M1, in such a manner that the direction of the body diode b2 is opposite to the direction of the body diode b1. Then, when the input voltage Vin is lower than the output voltage Vout, the switch control circuit 20 switches off the MOS transistor M2, and thus a reverse flow of a current that is generated at the time of power supply disconnection or the like is decreased. Furthermore, during a normal operation in which a constant voltage is output from the output voltage Vout, the switch control circuit 20 switches on the MOS transistor M2, and thus the regulator circuit 1 does not cause a large voltage drop therein.

In addition, in a first specific example, the comparator 21 switches off the MOS transistor M2 after the reverse flow of a current is detected. For this reason, in a case of the first specific example, the regulator circuit 1 makes the current reversely flow for a while, immediately after the power supply disconnection. The reverse flowing current that is generated at this time may be several amperes.

In general, the regulator circuit 1 includes the output terminal OUT to which a capacitor or an apparatus having a capacitor is connected. In FIG. 3, the capacitor is denoted by C0. A capacitor without an equivalent series resistance (ESR) and an equivalent series inductance (ESL) is ideal, but all capacitors have an ESR and an ESL in fact. In the same manner, an inner wire and an outer wire of the regulator circuit 1 also have an ESR and an ESL although small. For this reason, if the MOS transistor M2 is switched off after the current reversely flows, a counter electromotive voltage is generated on the current path by the ESL. The counter electromotive voltage generates an overshoot in the output voltage Vout. The overshoot may break a connection apparatus that is connected to the output terminal OUT, in a worst case.

According to the present embodiment, the comparator 21 switches off the MOS transistor M2 not at timing in which the input voltage Vin decreases to a value lower than the output voltage Vout, but at timing in which the input voltage Vin decreases to a value lower than a third voltage different from the output voltage Vout. The third voltage is a higher voltage than the output voltage Vout by a set voltage Va. The set voltage Va is determined in advance during manufacturing. The set voltage Va is a voltage higher than, for example, 10 mV. The set voltage Va may be a voltage higher than 100 mV. As a result, the regulator circuit 1 switches off the MOS transistor M2 not after the current reversely flows, but in a state immediately before the current reversely flows (for example, a state where a voltage that is obtained by subtracting the set voltage Va from the input voltage Vin is lower than the output voltage Vout), and thus it is possible to suppress an overshoot that may be caused in the output voltage Vout.

Second Specific Example according to First Embodiment

Figure 4:
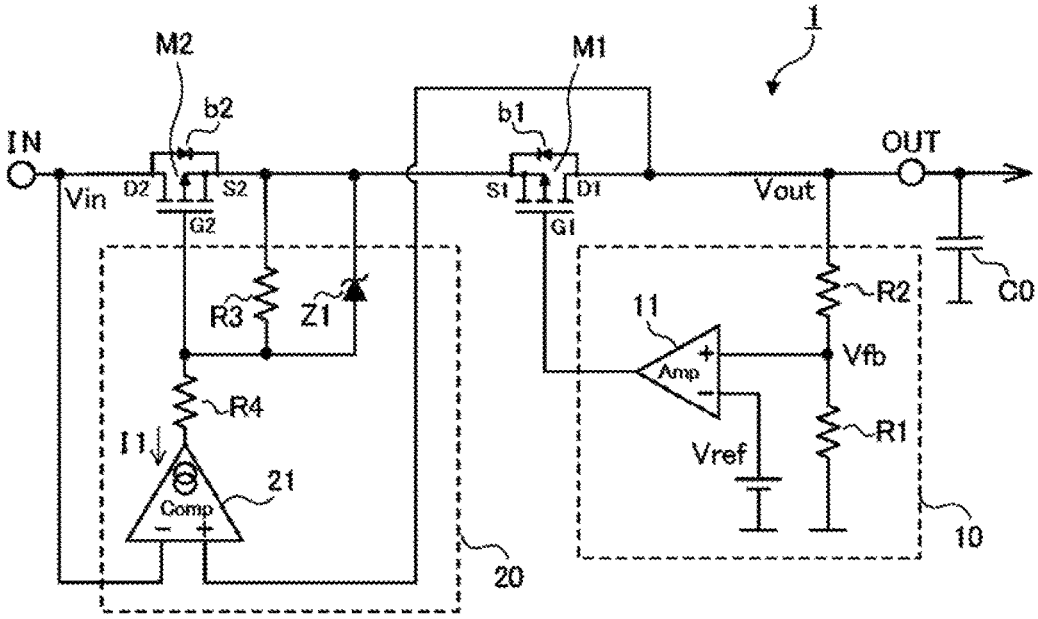

FIG. 4 is another circuit configuration example according to the first embodiment. A regulator circuit 1 in FIG. 4 is different from the regulator circuit 1 in FIG. 3 in that a resistor R4 is provided between the output terminal of the comparator 21 and the gate terminal G2. The resistor R4 is for gradual rising and falling of a voltage that is applied to the gate terminal G2. The other configuration is the same as that of the first specific example illustrated in FIG. 3, and thus description thereof will be omitted.

According to the present embodiment, rising and falling of the voltage that is applied to the gate terminal G2 becomes gradual by the resistor R4, and thus switching-off of the MOS transistor M2 becomes gradual. As a result, the overshoot that is generated in the output voltage Vout is suppressed.

In addition, the comparator 21 may switch off the MOS transistor M2 at timing in which the input voltage Vin decreases to a value lower than the third voltage that is higher than the output voltage Vout by the set voltage Va. Since the MOS transistor M2 is switched off in a state immediately before the current reversely flows, the regulator circuit 1 may further decrease the reverse flow of a current.

Third Specific Example according to First Embodiment

Figure 5:
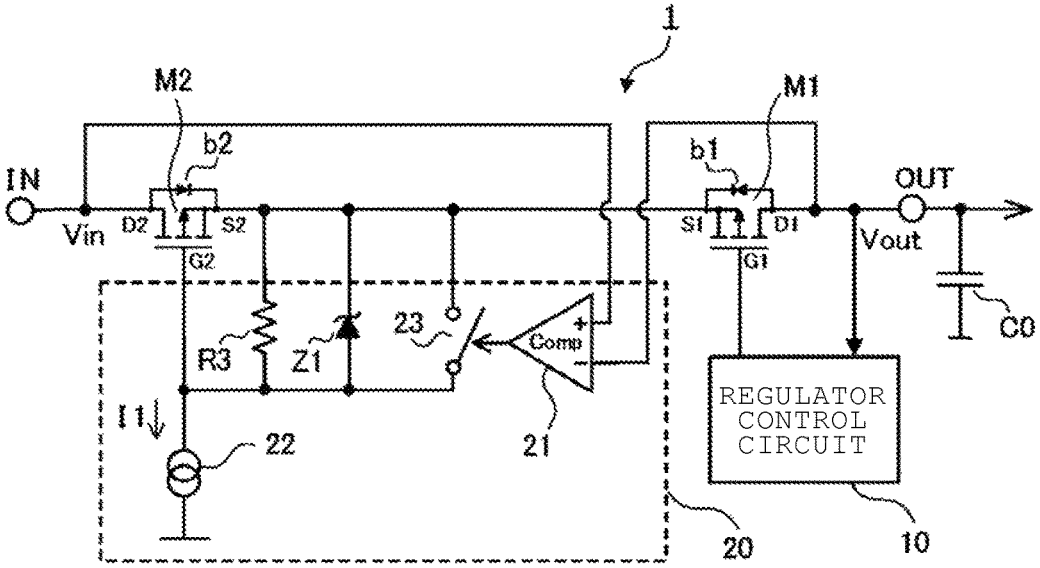

FIG. 5 is another circuit configuration example according to the first embodiment. A regulator circuit 1 includes the MOS transistor M1, the MOS transistor M2, the regulator control circuit 10, and a switch control circuit 20. The MOS transistors M1 and M2 and the regulator control circuit 10 are the same as those of FIG. 3, and thus description thereof will be omitted.

The switch control circuit 20 includes the resistor R3, the Zener diode Z1, the comparator 21, a current source 22, and a connection switch 23. One end of the resistor R3 is connected to the source terminal S2 of the MOS transistor M2, and the other end of the resistor R3 is connected to the gate terminal G2 of the MOS transistor M2.

The current source 22 is a current source that outputs the current I1. When the MOS transistor M2 is a P-ch MOSFET, the current I1 is a current that flows in a reverse direction. An output terminal of the current source 22 is connected to a gate terminal G2.

The connection switch 23 is a switch for connecting the gate terminal G2 and the source terminal S2 to each other. The connection switch 23 is configured with a semiconductor switch, for example, a P-ch MOSFET. One end of the connection switch 23 is connected to the source terminal S2, and the other end of the connection switch 23 is connected to the gate terminal G2. The connection switch 23 is switched on or off, based on the output of the comparator 21.

The comparator 21 controls the connection switch 23. The plus terminal of the comparator 21 is connected to the power supply current path L1, and the minus terminal of the comparator 21 is connected to the power supply current path L3. In addition, the output terminal of the comparator 21 is connected to a control terminal (for example, gate terminal) of the connection switch 23.

If the voltage Vin becomes higher than the output Vout, the comparator 21 switches off the connection switch 23. In that case, a negative voltage is applied to the gate terminal G2 by the output current I1, and thus the MOS transistor M2 is switched on. As a result, the regulator circuit 1 enters a state which is approximately the same as a state in which the input terminal IN and the MOS transistor M1 are directly connected to each other. In this state, the amplifier 11 of the regulator control circuit 10 controls the gate terminal G1 based on a difference of voltage between the feedback voltage Vfb and the reference voltage Vref, and thus the output voltage Vout is maintained constant.

Meanwhile, if the voltage Vin becomes lower than the output Vout, the comparator 21 switches on the connection switch 23. In that case, the source terminal S2 and the gate terminal G2 are disconnected, and thus the MOS transistor M2 is switched off. At this time, the body diode b2 functions as a diode for reverse flow prevention. For this reason, the reverse flow of a current is not generated in the regulator circuit 1.

According to the present embodiment, the connection switch 23 is provided between the source terminal S2 and the gate terminal G2. The comparator 21 controls the connection switch 23 and thus the source and the gate of the MOS transistor M2 are disconnected. As a result, a switch-off speed of the MOS transistor M2 is quickened, and the regulator circuit 1 may cope with a fast power interruption.

In addition, the comparator 21 may switch on the connection switch 23 at timing at which the input voltage Vin becomes lower than the third voltage that is higher than the output voltage Vout by the set voltage Va. As a result, the MOS transistor M2 is switched off in a state immediately before the reverse flow, and thus the regulator circuit 1 may further decrease the reverse flow of a current. Furthermore, the regulator circuit 1 may suppress the overshoot that is caused in the output voltage Vout.

Fourth Specific Example according to First Embodiment

Figure 6:
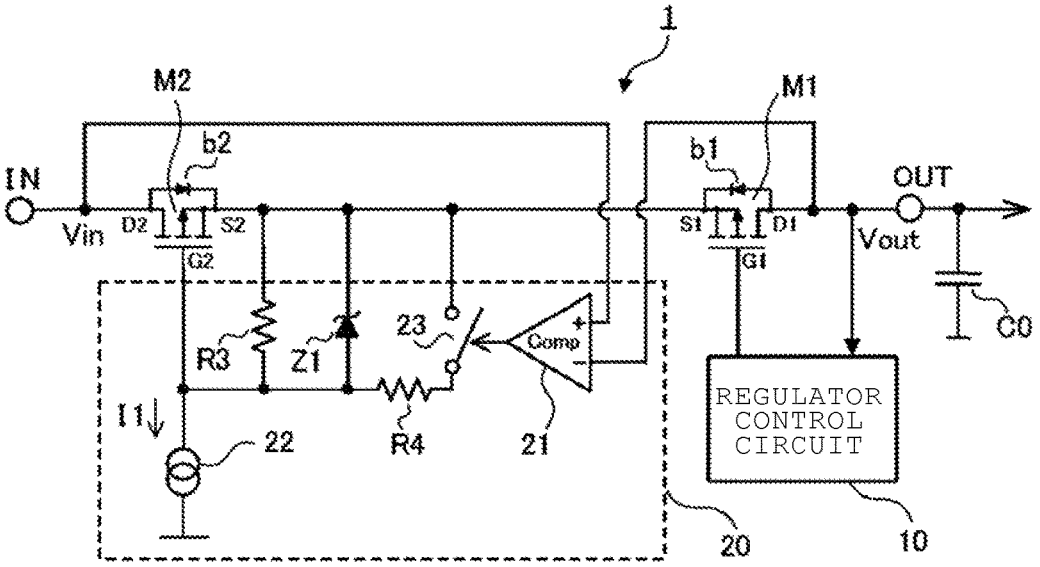

FIG. 6 is a third circuit configuration example according to the first embodiment. A regulator circuit 1 of FIG. 6 is different from the regulator circuit 1 of FIG. 5 in that the resistor R4 is provided. The resistor R4 is provided between the output terminal of the comparator 21 and the gate terminal G2. More specifically, the resistor R4 is provided between the connection switch 23 and the gate terminal G2. The other configuration is the same as that of the first specific example illustrated in FIG. 3, and thus description thereof will be omitted.

According to the present embodiment, rising of the voltage that is applied to the gate terminal G2 becomes gradual because of the resistor R4, and thus although the comparator 21 switches off the MOS transistor M2 after the reverse flow of a current is generated, the overshoot is not caused in the output voltage Vout.

In addition, in the same manner as that of the third specific example, the comparator 21 may switch on the connection switch 23 at timing at which the input voltage Vin becomes lower than the third voltage that is higher than the output voltage Vout by the set voltage Va. By doing this, the MOS transistor M2 is switched off immediately before the current reversely flows, the regulator circuit 1 may further decrease the reverse flow of a current.

(Second Embodiment)

Figure 7:
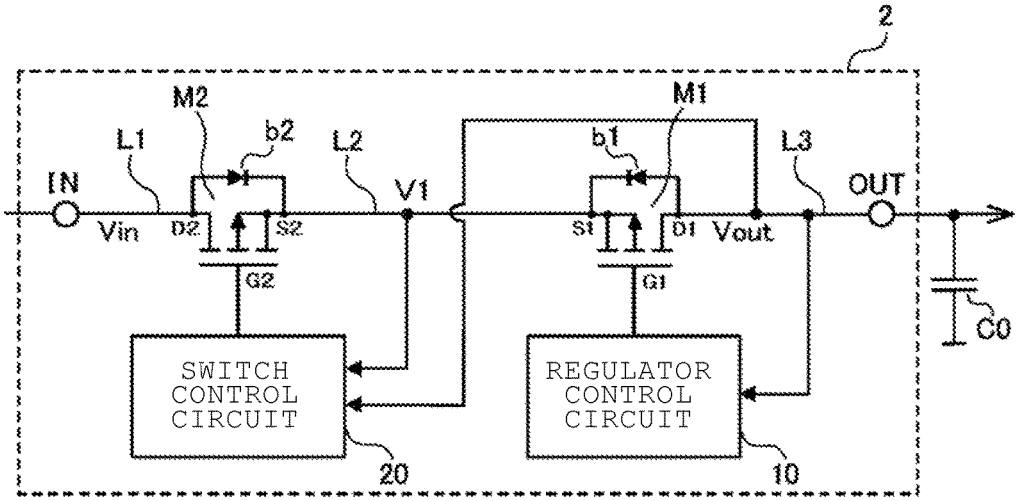
FIG. 7 illustrates a regulator circuit according to a second embodiment.

FIG. 7 illustrates a regulator circuit according to a second embodiment. The regulator circuit 2 according to the second embodiment controls the MOS transistor M2 based on comparison of a voltage at the power supply current path L2 and a voltage at the power supply current path L3. Hereinafter, the regulator circuit 2 will be described.

First Specific Example according to Second Embodiment

Figure 8:
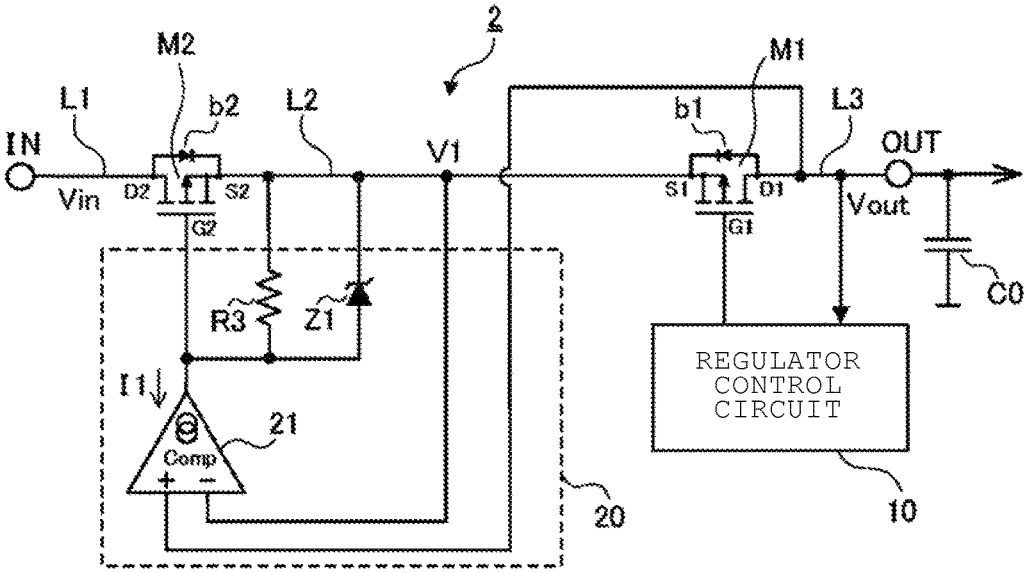
FIGS. 8-11 are specific circuit configuration examples of the regulator circuit illustrated in FIG. 7.

FIG. 8 is a specific circuit configuration example of the regulator circuit 2 illustrated in FIG. 7. The regulator circuit 2 includes the MOS transistor M1, the MOS transistor M2, the regulator control circuit 10, and the switch control circuit 20. The MOS transistors M1 and M2, and the regulator control circuit 10 are the same as those of FIG. 3, and thus description thereof will be omitted.

The switch control circuit 20 includes the resistor R3, the Zener diode Z1, and the comparator 21. One end of the resistor R3 is connected to the source terminal S2, and the other end of the resistor R3 is connected to the gate terminal G2.

The comparator 21 controls the MOS transistor M2. The minus terminal of the comparator 21 is connected to the power supply current path L2, and the plus terminal of the comparator 21 is connected to the power supply current path L3. In addition, the output terminal is connected to the gate terminal G2. If a voltage V1 at the power supply current path L2 is lower than the output voltage Vout at the power supply current path L3, the reverse flow of a current is generated, and the comparator 21 stops an output of the current I1 to the MOS transistor M2. As a result, the MOS transistor M2 is switched off and the reverse flow of a current is suppressed.

According to the present embodiment, the MOS transistor M2 is disposed between the input terminal IN and the source terminal S1, and thus the regulator circuit 2 decreases the reverse flow of a current. Furthermore, the regulator circuit 2 does not cause a large voltage drop in its circuit.

In addition, in the same manner as that of the first specific example according to the first embodiment, the comparator 21 may switch off the MOS transistor M2 at timing at which the voltage V1 at the power supply current path L2 becomes lower than a third voltage that is different from the output voltage Vout. At this time, the third voltage is a higher voltage than the output voltage Vout by the set voltage Va. The set voltage Va is a higher voltage than, for example, 10 mV. The set voltage Va may be a higher voltage than 100 mV. As a result, the MOS transistor M2 is switched off immediately before the current reversely flows (for example, when a voltage that is obtained by subtracting the set voltage Va from the voltage V1 becomes lower than the output voltage Vout), and thus the regulator circuit 2 may further decrease the reverse flow of a current.

Second Specific Example according to Second Embodiment

Figure 9:
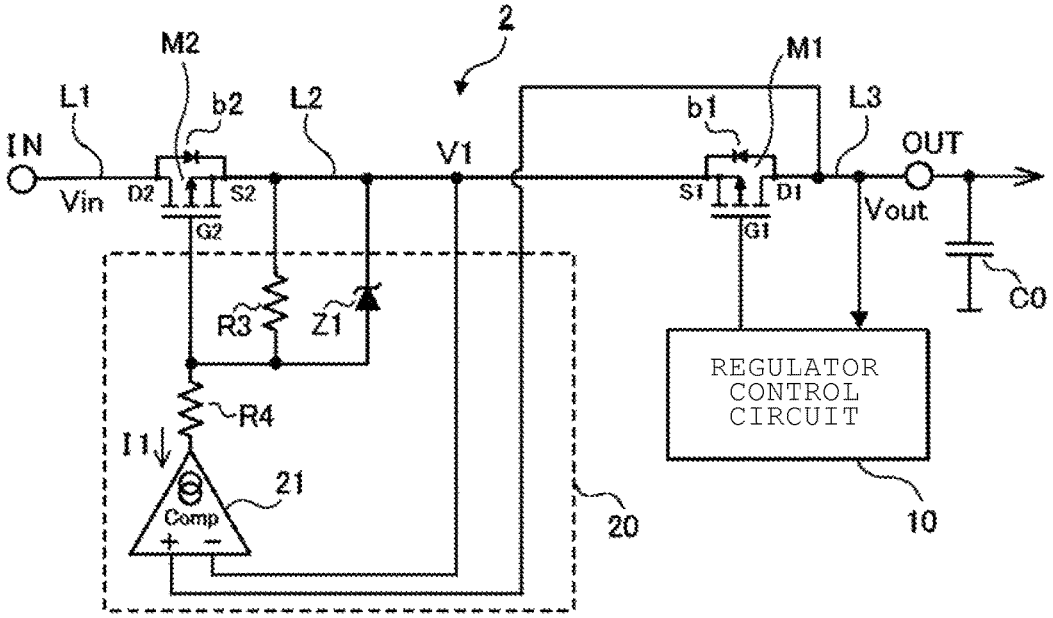

FIG. 9 is another circuit configuration example of a regulator circuit 2 according to the second embodiment. The regulator circuit 2 is different from the regulator circuit 1 of the second specific example according to the first embodiment illustrated in FIG. 4 in that the minus terminal of the comparator 21 is connected to the power supply current path L2. The other configuration is the same as the regulator circuit 1 of the second specific example according to the first embodiment, and thus description thereof will be omitted.

According to the present embodiment, rising of the voltage that is applied to the gate terminal G2, rather than to the resistor R4, becomes gradual because of the resistor R4, and thus although the MOS transistor M2 is switched off after the current reversely flow, the overshoot is unlikely to be caused in the output voltage Vout.

In addition, in the same manner as that of the second specific example according to the first embodiment, the comparator 21 may switch off the MOS transistor M2 at timing at which the voltage V1 at the power supply current path L2 becomes lower than a third voltage that is higher than the output voltage Vout by the set voltage Va. Since the MOS transistor M2 is switched off immediately before the current reversely flows, the regulator circuit 2 may further decrease the reverse flow of a current.

Third Specific Example according to Second Embodiment

Figure 10:
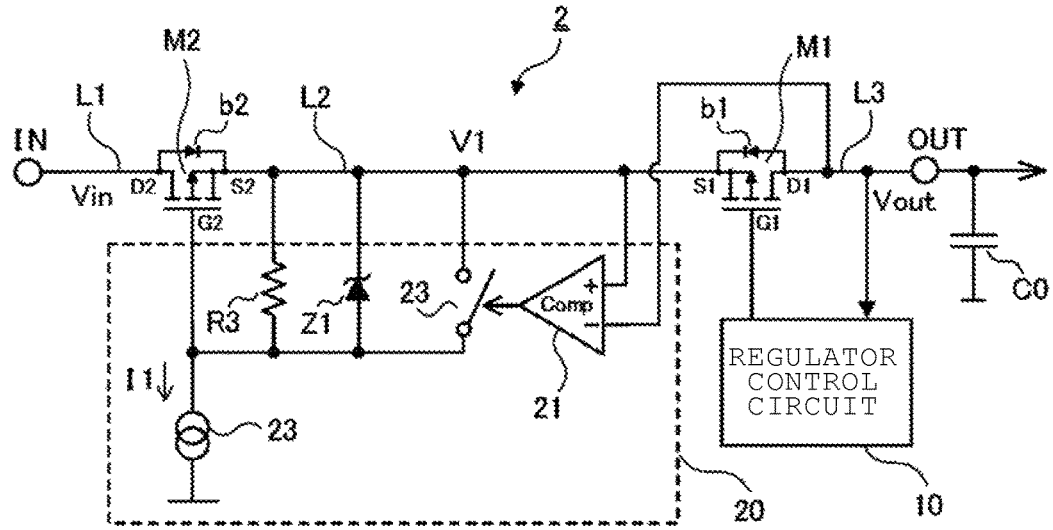

FIG. 10 is another circuit configuration example of a regulator circuit 2 according to the second embodiment. The regulator circuit 2 is different from the regulator circuit of the third specific example according to the first embodiment illustrated in FIG. 5 in that the minus terminal of the comparator 21 is connected to the power supply current path L2. The other configuration is the same as the regulator circuit 1 of the third specific example according to the first embodiment, and thus description thereof will be omitted.

According to the present embodiment, the switch control circuit 20 switches on the connection switch 23, thereby switching off the MOS transistor M2, and thus a switch-off speed of the MOS transistor M2 is quickened. As a result, the regulator circuit 2 may cope with a fast power interruption.

In addition, in the same manner as that of the third specific example according to the first embodiment, the comparator 21 may switch on the connection switch 23 at timing at which the voltage V1 at the power supply current path L2 becomes lower than a third voltage that is higher than the output voltage Vout by the set voltage Va. As a result, since the MOS transistor M2 is switched off immediately before the current reversely flows, the regulator circuit 2 may further decrease the reverse flow of a current. Furthermore, the regulator circuit 2 may suppress the overshoot that is generated in the output voltage Vout.

Fourth Specific Example according to Second Embodiment

Figure 11:
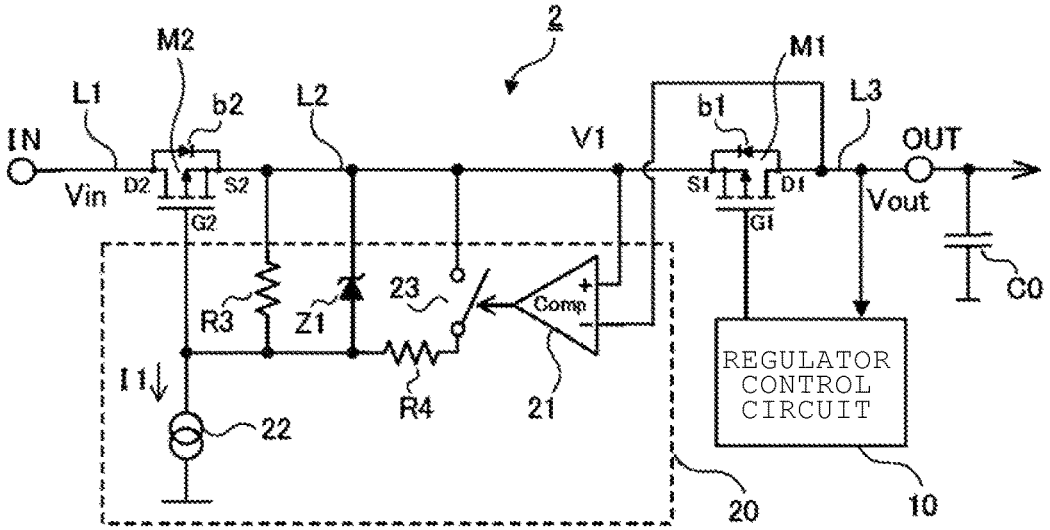

FIG. 11 is a fourth circuit configuration example of a regulator circuit 2 according to the second embodiment. The regulator circuit 2 is different from the regulator circuit 1 of the fourth specific example according to the first embodiment illustrated in FIG. 6 in that the minus terminal of the comparator 21 is connected to the power supply current path L2. The other configuration is the same as the regulator circuit 1 of the fourth specific example according to the first embodiment illustrated in FIG. 6, and thus description thereof will be omitted.

According to the present embodiment, rising of the voltage that is applied to the gate terminal G2, rather than to the resistor R4, becomes gradual because of the resistor R4, and thus although the comparator 21 switches off the MOS transistor M2 after the current reversely flow, the overshoot is unlikely to be caused in the output voltage Vout.

In addition, in the same manner as that of the fourth specific example according to the first embodiment, the comparator 21 may switch on the connection switch 23 at timing at which the voltage V1 at the power supply current path L2 becomes lower than a third voltage that is higher than the output voltage Vout by the set voltage Va. As a result, since the MOS transistor M2 is switched off immediately before the current reversely flows, the regulator circuit 2 may further decrease the reverse flow of a current.

(Third Embodiment)

Figure 12:
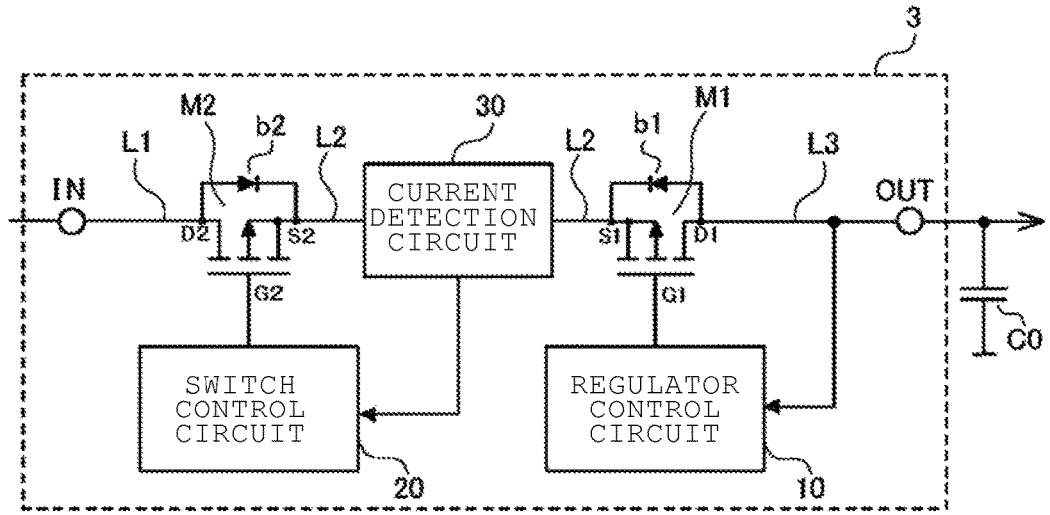
FIG. 12 illustrates a regulator circuit according to a third embodiment.

FIG. 12 illustrates a regulator circuit according to a third embodiment. When a current detection circuit 30 detects a reverse flow of a current, the regulator circuit 3 according to the third embodiment switches off the MOS transistor M2. Hereinafter, the regulator circuit 3 will be described.

First Specific Example according to Third Embodiment

Figure 13:
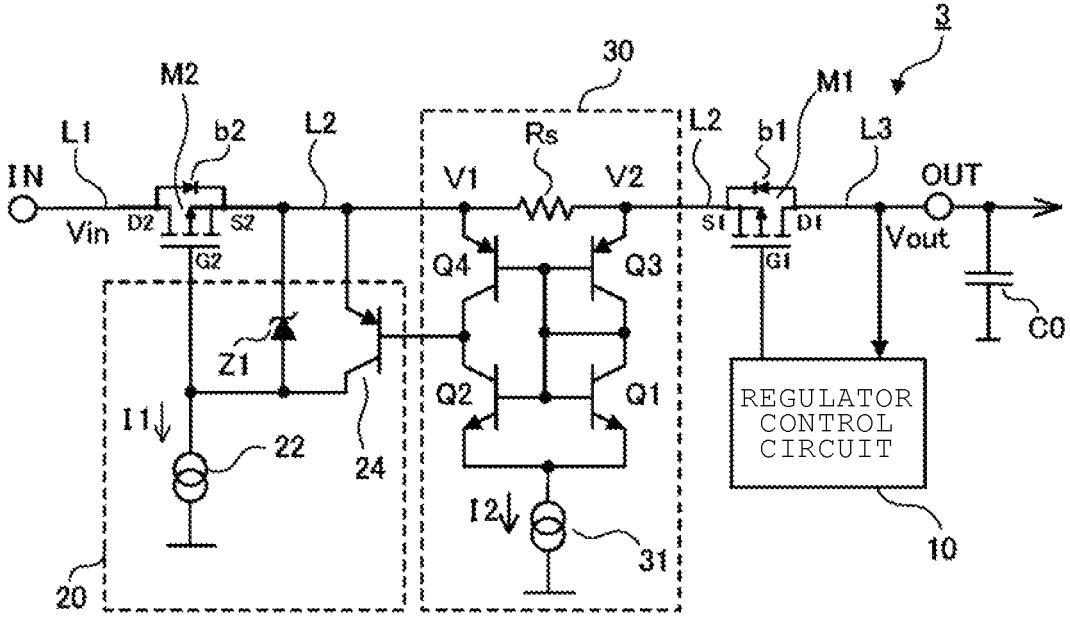
FIGS. 13-16 are specific circuit configuration examples of the regulator circuit illustrated in FIG. 12.

FIG. 13 is a specific circuit configuration example of the regulator circuit 3 illustrated in FIG. 12. The regulator circuit 3 includes the MOS transistor M1, the MOS transistor M2, the regulator control circuit 10, the switch control circuit 20, and the current detection circuit 30. The MOS transistors M1 and M2, and the regulator control circuit 10 are the same as those of FIG. 3, and thus description thereof will be omitted.

The switch control circuit 20 includes the Zener diode Z1, a current source 22, and a transistor 24. One end of the Zener diode Z1 is connected to the source terminal S2, and the other end of the Zener diode Z1 is connected to the gate terminal G2. In addition, an output terminal of the current source 22 is connected to the gate terminal G2.

The transistor 24 is a PNP type bipolar transistor. An emitter terminal of the transistor 24 is connected to the source terminal S2, and a collector terminal of the transistor 24 is connected to the gate terminal G2 and the output terminal of the current source 22. In addition, a base terminal of the transistor 24 is connected to an output terminal of the current detection circuit 30. The transistor 24 connects the emitter to the collector, depending on an output of the current detection circuit 30.

The current detection circuit 30 detects a current flowing through a power supply current path. The current detection circuit 30 includes a current detection resistor Rs, transistors Q1 to Q4, and a current source 31.

The current detection resistor Rs is used to detect a direction of a current flowing through the power supply current path. The current detection resistor Rs is disposed in the power supply current path L2. Specifically, one end of the current detection resistor Rs is connected to the source terminal S2, and the other end of the current detection resistor Rs is connected to the source terminal S1. In addition, the current detection resistor Rs is a resistor only for detecting a direction of a current, and thus may be a small resistor. For example, the current detection resistor Rs may be a small resistor which is included in a wire that connects the MOS transistor M2 to the MOS transistor M1. The small resistor that the wire has may be used as the current detection circuit Rs, and thus the regulator circuit 3 may prevent a large voltage drop from being caused by an additional resistor.

The transistors Q1 to Q4 detect a current flowing through the current detection resistor Rs. The transistors Q1 and Q2 are NPN type bipolar transistors, the transistors Q3 and Q4 are PNP type bipolar transistors.

An emitter terminal of the transistor Q1 is connected to an output terminal of the current source 31, and a collector terminal of the transistor Q1 is connected to a collector terminal of the transistor Q3 and base terminals of the transistors Q1 to Q4. In addition, an emitter terminal of the transistor Q2 is connected to the output terminal of the current source 31, and a collector terminal of the transistor Q2 is connected to a collector terminal of the transistor Q4 and a base terminal of the transistors 24. In addition, an emitter terminal of the transistor Q3 is connected to the one end (transistor M1 side) of the current detection resistor Rs, and a collector terminal of the transistor Q3 is connected to a collector terminal of the transistor Q1 and base terminals of the transistors Q1 to Q4. In addition, an emitter terminal of the transistor Q4 is connected to the one end (transistor M2 side) of the current detection resistor Rs, and a collector terminal of the transistor Q4 is connected to a collector terminal of the transistor Q2 and a base terminal of the transistors 24. Also, the bases of all the transistors are respectively connected to the base terminal of other transistor.

The current source 31 outputs a current I2. The output terminal of the current source 31 is connected to the emitter terminals of the transistors Q1 and Q2.

The other configurations of the regulator circuit 3 are the same as those of the regulator circuit 1 of first specific example according to the first embodiment illustrated in FIG. 3, and thus description thereof will be omitted.

Next, an operation of the regulator circuit 3 having such configurations will be described.

If the power supply voltage is applied to the input terminal IN, a forward current flows into the current detection resistor Rs. Since an emitter voltage V1 of the transistor Q4 is higher than an emitter voltage V2 of the transistor Q3, the emitter and the collector of the transistor Q4 are connected to each other. In that case, the emitter and the base of the transistor 24 are connected to each other, and the transistor 24 is switched off. In that case, a negative voltage is applied to the gate terminal G2 by the current source 22, and thus the MOS transistor M2 is switched on. As a result, the source and the drain of the MOS transistor M2 are connected to each other, and thus a large voltage drop is not caused between the input terminal IN and the MOS transistor M1.

Meanwhile, if application of the power supply voltage to the input terminal IN is stopped, a backward current flows through the current detection resistor Rs. By doing this, an emitter voltage V1 of the transistor Q4 becomes lower than an emitter voltage V2 of the transistor Q3, and thus the emitter and the collector of the transistor Q4 are disconnected. In that case, a base voltage of the transistor 24 is lowered, and thus the transistor 24 is switched on. In that case, a voltage at the gate terminal G2 increases, and thus the MOS transistor M2 is switched off. At this time, the body diode b2 functions as a diode for reverse flow prevention, and thus the reverse flow of a current is suppressed.

According to the present embodiment, the MOS transistor M2 is disposed between the input terminal IN and the MOS transistor M1, in such a manner that the direction of the body diode b2 is opposite to the direction of the body diode b1, and then when the current detection circuit 30 detects a reverse flow of a current, the switch control circuit 20 switches off the MOS transistor M2. Thus, it is possible to decrease the reverse flow of a current at the time of power supply disconnection or the like. Furthermore, during a normal operation in which a current does not reversely flow, the switch control circuit 20 switches on the MOS transistor M2, and thus the regulator circuit 3 does not cause a large voltage drop in the circuit.

In addition, an emitter size of the transistor Q3 may be larger than an emitter size of the transistor Q4. For example, the emitter size of the transistor Q3 maybe two times the emitter size of the transistor Q4. As a result, when a current (hereinafter, referred to as "forward current") from the input terminal IN toward the output terminal OUT is in a small current state (that is, state immediately before the reverse flow) before being zero, the MOS transistor M2 is switched off, and thus the regulator circuit 3 may further decrease the reverse flow of a current. Furthermore, the regulator circuit 3 may decrease the overshoot that is generated in the output voltage Vout.

Second Specific Example according to Third Embodiment

Figure 14:
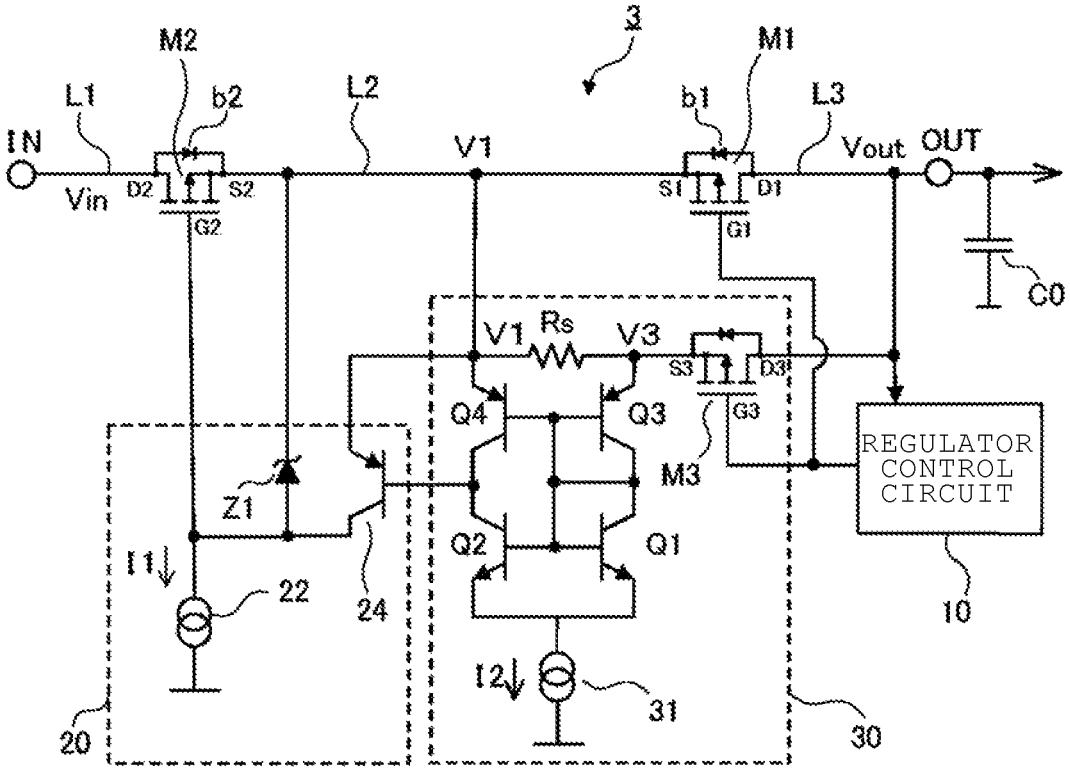

FIG. 14 is another circuit configuration example according to the third embodiment. The regulator circuit 3 includes the MOS transistor M1, the MOS transistor M2, the regulator control circuit 10, the switch control circuit 20, and the current detection circuit 30. The MOS transistors M1 and M2, the regulator control circuit 10, and the switch control circuit 20 are the same as those of the first specific example according to the third embodiment, and thus description thereof will be omitted.

The current detection circuit 30 detects a current flowing through the power supply current path. The current detection circuit 30 includes a MOS transistor M3, a current detection resistor Rs, the transistors Q1 to Q4, and the current source 31. The transistors Q1 to Q4 and the current source 31 are the same as those of the first specific example according to the third embodiment.

The MOS transistor M3 is an enhancement type P-ch MOSFET. The MOS transistor M3 is disposed on a current path different from the power supply current paths L1 to L3. A drain terminal D3 of the MOS transistor M3 is connected to the output terminal OUT, and a source terminal S3 is connected to one end of the current detection resistor Rs and an emitter of the transistor Q3. In addition, a gate terminal G3 is connected to the output of the regulator control circuit 10. In addition, the MOS transistor M3 may be an N-ch MOSFET. In this case, the source S3 is connected to the output terminal OUT, the drain terminal D3 is connected to one end of the current detection resistor Rs and the emitter of the transistor Q3.

The current detection resistor Rs is used to detect a direction of a current flowing through the power supply current path. One end of the current detection resistor Rs is connected to the source terminal S2 and an emitter of the transistor Q4, and the other end of the current detection resistor Rs the source terminal S3 of the MOS transistor M3.

According to the present embodiment, when the current detection circuit 30 detects the reverse flow of a current, the switch control circuit 20 switches off the MOS transistor M2, and thus it is possible to decrease the reverse flow of a current at the time of the power supply disconnection or the like. Furthermore, during a normal operation, the switch control circuit 20 switches on the MOS transistor M2, and thus the regulator circuit 3 does not cause a large voltage drop in the circuit.

In addition, a size of the emitter of the transistor Q3 may be larger than a size of the emitter of the transistor Q4. As a result, in a state immediately before the current reversely flows, the MOS transistor M2 is switched off, and thus the regulator circuit 3 may further decrease the reverse flow of a current. Furthermore, the regulator circuit 3 may also decrease the overshoot that is caused in the output voltage Vout.

Third Specific Example according to Third Embodiment

Figure 15:
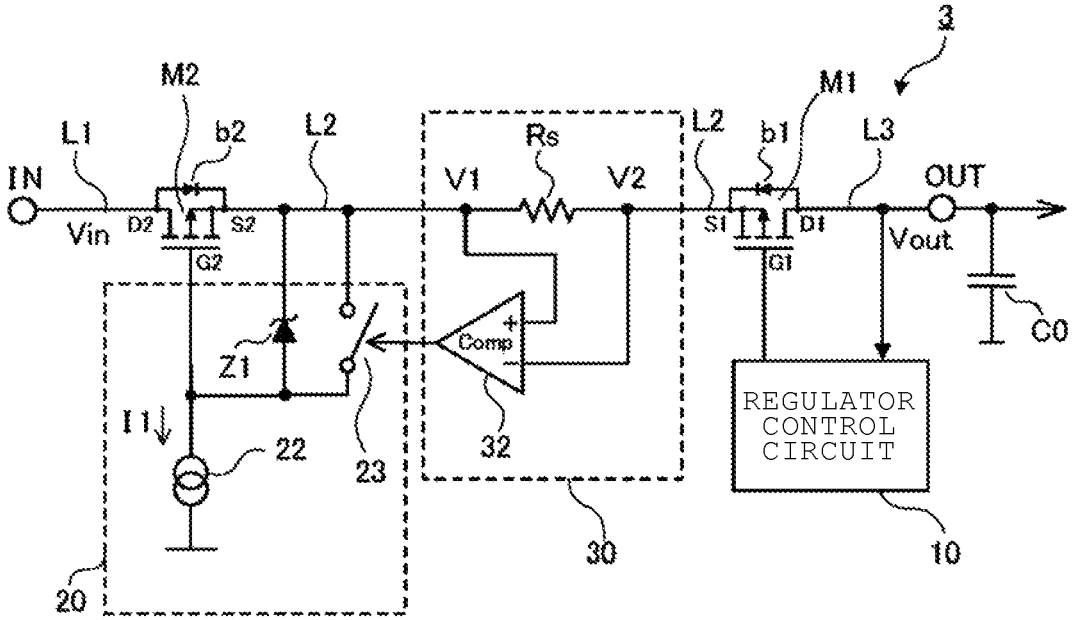

FIG. 15 is another circuit configuration example according to the third embodiment. A regulator circuit 3 of a third specific example is different from the regulator circuit 3 of the first specific example according to the third embodiment illustrated in FIG. 13 in that the transistor 24 is replaced with the connection switch 23, and the transistors Q1 to Q4 and the current source 31 are replaced with the comparator 32.

One end of the connection switch 23 is connected to the source terminal S2, and the other end of the connection switch 23 is connected to the gate terminal G2. In addition, the plus terminal of the comparator 32 is connected to one end (transistor M2 side) of the current detection resistor Rs. The minus terminal of the comparator 32 is connected to the other end (transistor M1 side) of the current detection resistor Rs. The output terminal of the comparator 32 is connected to a control terminal (gate terminal if the connection switch 23 is a MOS transistor or the like) of the connection switch 23. If a voltage at the minus terminal becomes lower than a voltage at the plus terminal, the comparator 32 switches off the connection switch 23, and if the voltage at the minus terminal becomes higher than the voltage at the plus terminal, the comparator 32 switches on the connection switch 23.

If the power supply voltage is applied to the input terminal IN, a forward current flows through the current detection resistor Rs. In that case, the voltage at the minus terminal of the comparator 32 becomes lower than the voltage at the plus terminal, and thus the comparator 32 switches off the connection switch 23. In that case, a negative voltage is applied to the gate terminal G2, and thus the MOS transistor M2 is switched on. As a result, the source and the drain are connected to each other, and thus a large voltage drop is not generated between the input terminal IN and the MOS transistor M1.

Meanwhile, if application of the power supply voltage to the input terminal IN is stopped, a backward current flows through the current detection resistor Rs. In that case, the voltage at the minus terminal of the comparator 32 becomes higher than the voltage at the plus terminal, and thus the comparator 32 switches on the connection switch 23. In that case, the source terminal S2 is disconnected from the gate terminal G2, and thus the MOS transistor M2 is switched off. At this time, as a conducting direction of the body diode b2 is opposite to that of the body diode b1, the body diode b2 functions as a diode for reverse flow prevention. For this reason, the reverse flow of a current is not caused in the regulator circuit 3.

According to the present embodiment, when the current detection circuit 30 detects the reverse flow of a current, the switch control circuit 20 switches off the MOS transistor M2, and thus it is possible to decrease the reverse flow of a current at the time of power supply disconnection or the like. Furthermore, during normal operation, the switch control circuit 20 switches on the MOS transistor M2, and thus the regulator circuit 3 does not cause a large voltage drop in its circuit.

Fourth specific Example according to Third Embodiment

Figure 16:
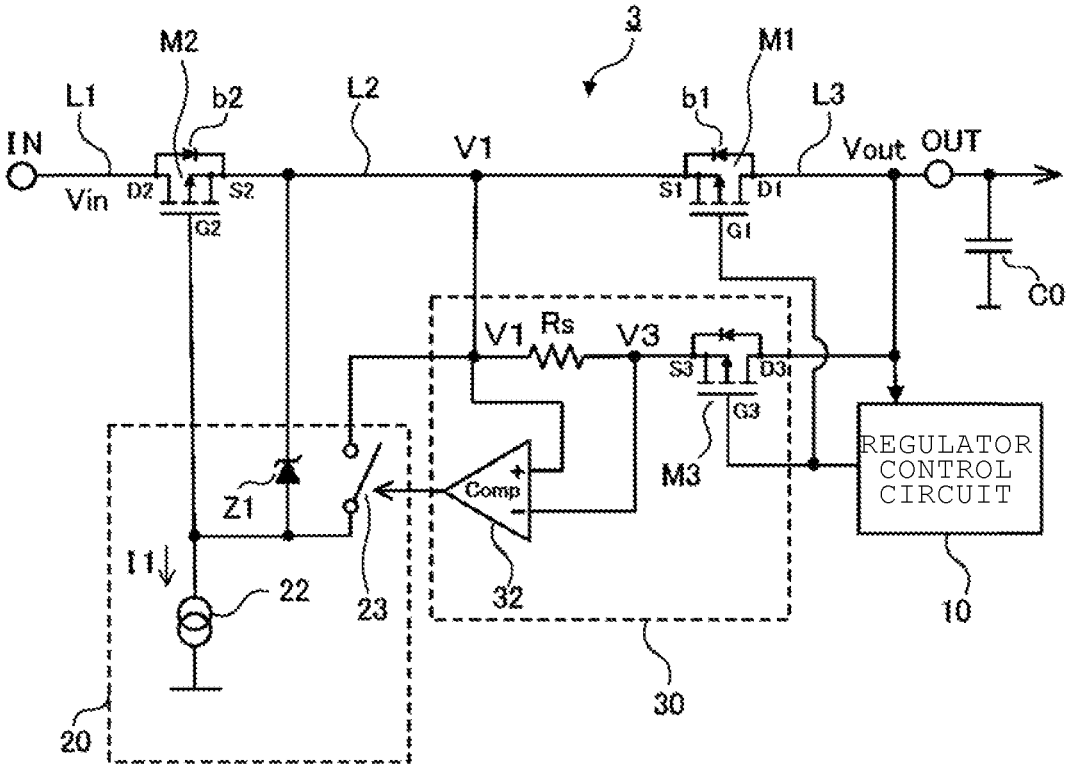

FIG. 16 is another circuit configuration example according to the third embodiment. A regulator circuit 3 of a fourth specific example is different from the regulator circuit 3 of the second specific example according to the third embodiment illustrated in FIG. 14 in that the transistor 24 is replaced with the connection switch 23, and the transistors Q1 to Q4 and the current source 31 are replaced with the comparator 32. Operations of the connection switch 23 and the comparator 32 are the same as the connection switch 23 and the comparator 32 described in the third specific example according to the third embodiment.

According to the present embodiment, when the current detection circuit 30 detects the reverse flow of a current, the switch control circuit 20 switches off the MOS transistor M2, and thus it is possible to decrease the reverse flow of a current at the time of power supply disconnection or the like. Furthermore, at the time of normal operation, the switch control circuit 20 switches on the MOS transistor M2, and thus the regulator circuit 3 does not cause a large voltage drop in its circuit.

In addition, each embodiment described above may be variously modified and applied.

Figure 17:
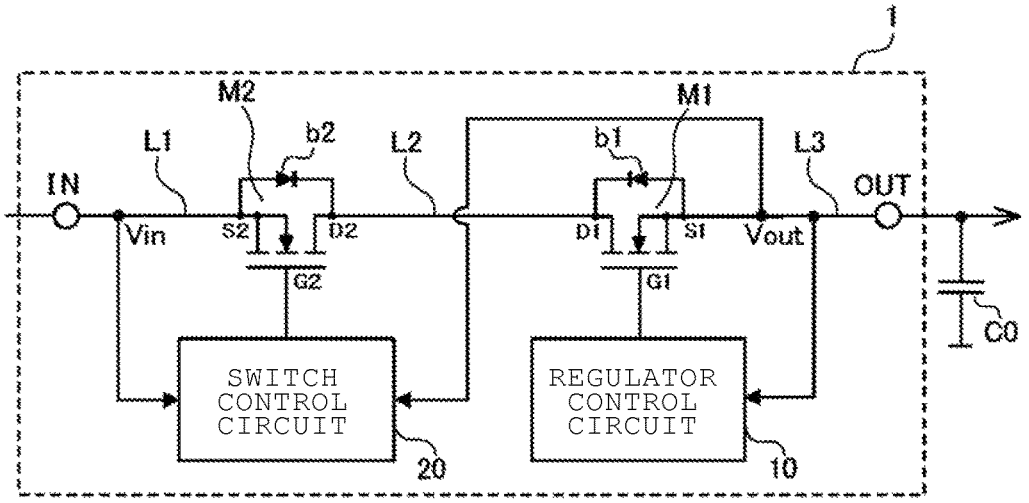
FIG. 17 illustrates a modification example of the regulator circuit according to the first embodiment.
Figure 18:
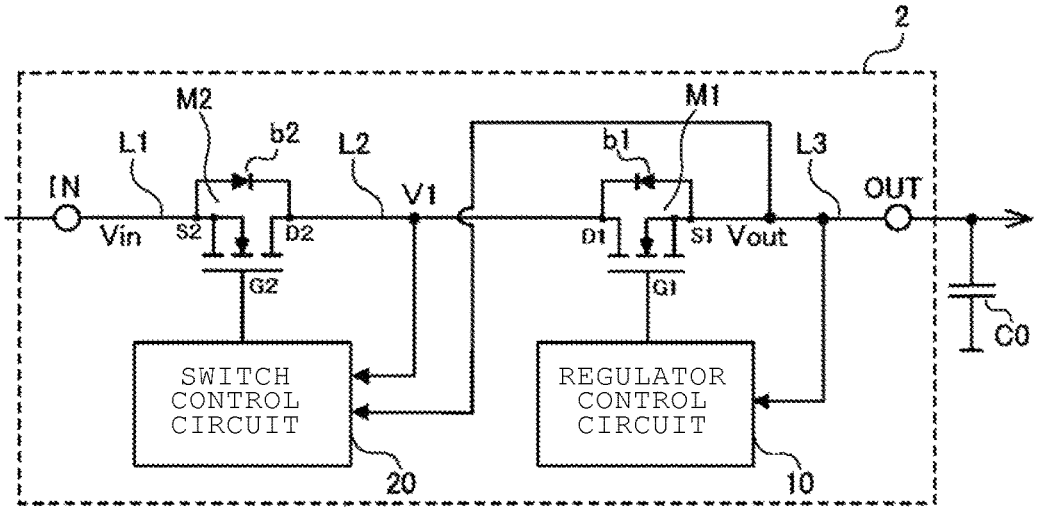
FIG. 18 illustrates a modification example of the regulator circuit according to the second embodiment.
Figure 19:
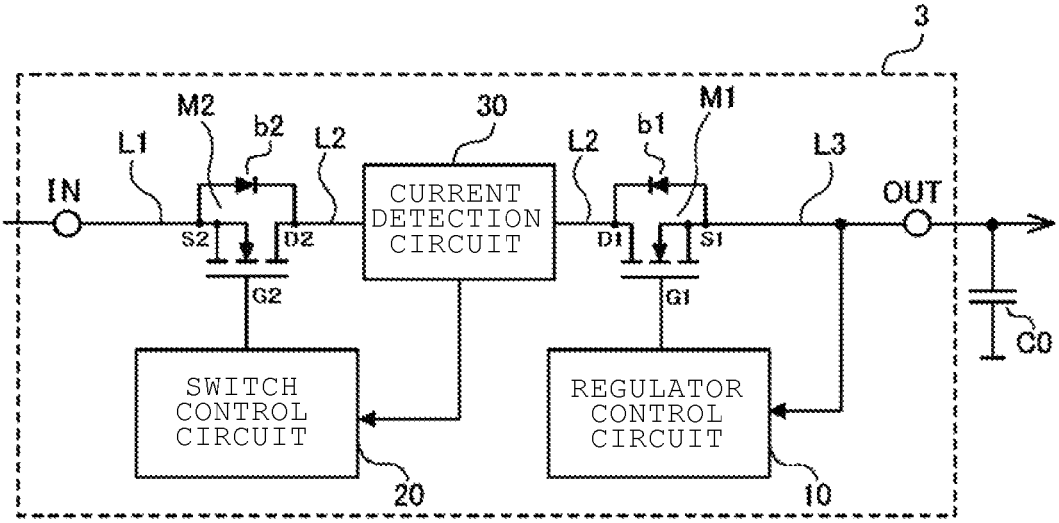
FIG. 19 illustrates a modification example of the regulator circuit according to the third embodiment.

For example, in each embodiment described above, the MOS transistors M1 and M2 are both P-ch MOSFETs, but as illustrated in FIG. 17, FIG. 18, and FIG. 19, the MOS transistors M1 and M2 may be N-ch MOSFETs. Alternatively, one of the MOS transistors M1 and M2 may be an N-ch MOSFET.

In addition, in each embodiment described above, the MOS transistors M1 and M2 are both enhancement type MOSFETs, but the MOS transistors M1 and M2 may be depletion type MOSFETs.

In addition, the comparators 21 and 32 may have hysteresis. In this case, the regulator circuits 1 to 3 may prevent the MOS transistor M2 from malfunctioning in the vicinity of a switch-on and switch-off threshold.

In addition, in each embodiment described above, the regulator circuits 1 to 3 are described as regulators for a vehicle, but the regulator circuits 1 to 3 are not limited to the regulator for a vehicle. For example, the regulator circuits 1 to 3 respectively may be a regulator circuit that is embedded in an electric apparatus such as a home appliance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A regulator circuit comprising:

a first MOS transistor having a current channel connected between an input terminal and an output terminal;

a regulator control circuit configured to control an amount of a current flowing through the current channel of the first MOS transistor towards the output terminal;

a second MOS transistor having a current channel connected between the input terminal and the current channel of the first MOS transistor, and a body diode, a forward direction of which is along a direction from the input terminal to the output terminal; and a switch control circuit configured to control the second MOS transistor, wherein the switch control circuit includes a comparator having first and second terminals as input terminals thereof and a third terminal as an output terminal thereof, the first terminal of the comparator connected to the input terminal, the second terminal of the comparator connected to the output terminal, and the third terminal of the comparator connected to a control electrode of the second MOS transistor by which a control signal is supplied to the second MOS transistor, and a resistor connected between the third terminal of the comparator and a node between the current channel of the first MOS transistor and the current channel of the second MOS transistor.

2. The regulator circuit according to claim 1, wherein the switch control circuit is further configured to detect that a voltage at the input terminal decreases to a predetermined value and control the second MOS transistor to switch off when the voltage at the input terminal decreases to the predetermined value.

3. The regulator circuit according to claim 1, wherein the first MOS transistor includes a body diode having a forward direction that is opposite to the forward direction of the body diode of the second MOS transistor.

4. The regulator circuit according to claim 1, wherein the switch control circuit is further configured to detect that a voltage at the node decreases to a predetermined value and control the second MOS transistor to switch off when the voltage at the node decreases to the predetermined value.

5. The regulator circuit according to claim 2, wherein the switch control circuit further includes a switch connected between the control electrode of the second MOS transistor and the node.

6. The regulator circuit according to claim 4, wherein the switch control circuit further includes a switch connected between the control electrode of the second MOS transistor and the node.

7. The regulator circuit according to claim 5, wherein the switch control circuit further includes a resistor connected between the control electrode of the second MOS transistor and the switch.

8. The regulator circuit according to claim 6, wherein the switch control circuit further includes a resistor connected between the control electrode of the second MOS transistor and the switch.

9. A regulator circuit comprising:

a first MOS transistor having a current channel connected between an input terminal and an output terminal;

a regulator control circuit configured to control an amount of a current flowing through the current channel of the first MOS transistor towards the output terminal;

a second MOS transistor having a current channel connected between the input terminal and the current channel of the first MOS transistor, and a body diode, a forward direction of which is along a direction from the input terminal to the output terminal;

a current detection circuit configured to detect a current flowing from the output terminal towards the input terminal; and a switch control circuit configured to switch off the second MOS transistor when the current detection circuit detects the current, wherein the current detection circuit has a first terminal connected to the current channel of the second MOS transistor, a second terminal connected to the current channel of the first MOS transistor, and a resistor connected between the first terminal and the second terminal.

10. The regulator circuit according to claim 9, wherein the first MOS transistor includes a body diode having a forward direction that is opposite to the forward direction of the body diode of the second MOS transistor.

11. A regulator circuit comprising:

a first MOS transistor haying a current channel connected between an input terminal and an output terminal;

a regulator control circuit configured to control an amount of a current flowing through the current channel of the first MOS transistor towards the output terminal;

a second MOS transistor haying a current channel connected between the input terminal and the current channel of the first MOS transistor, and a body diode, a forward direction of which is along a direction from the input terminal to the output terminal;

a current detection circuit configured to detect a current flowing from the output terminal towards the input terminal; and a switch control circuit configured to switch off the second MOS transistor when the current detection circuit detects the current, wherein the current detection circuit is connected between the current channel of the second MOS transistor and the output terminal and in parallel to the current channel of the first MOS transistor.

12. The regulator circuit according to claim 11, wherein the current detection circuit has a first terminal connected between the current channel of the second MOS transistor and the current channel of the first MOS transistor, a second terminal connected to the output terminal, and a resistor connected between the first terminal and the second terminal.

* * * * *